United States Patent [19]

Jansen

[11] 4,299,260

[45] Nov. 10, 1981

[54] HYDROCARBON PRODUCTION TERMINAL

[75] Inventor: Martin B. Jansen, Agoura, Calif.

[73] Assignee: Amtel, Inc., Providence, R.I.

[21] Appl. No.: 91,821

[22] Filed: Nov. 6, 1979

Related U.S. Application Data

[63] Continuation-in-part of Ser. No. 49,960, Jun. 18, 1979.

[51] Int. Cl.[3] ..... B65B 3/04; F16L 39/04

[52] U.S. Cl. ..... 141/311 R; 137/615; 141/387

[58] Field of Search ..... 9/8 P; 137/606, 615; 141/279, 284, 387, 388, 311 R; 166/91; 285/119; 405/164, 195

[56] References Cited

U.S. PATENT DOCUMENTS

| | | | |
|---|---|---|---|
| 2,316,383 | 4/1943 | Abercrombie | 166/91 |
| 3,742,536 | 7/1973 | Sada et al. | 141/388 X |
| 3,921,557 | 11/1975 | Kapteijn et al. | 141/387 |
| 3,980,037 | 9/1976 | Tuson | 141/388 X |
| 4,026,119 | 5/1977 | Dotti | 141/388 X |
| 4,090,538 | 5/1978 | Kotcharian | 141/387 X |

*Primary Examiner*—Frederick R. Schmidt
*Attorney, Agent, or Firm*—Freilich, Hornbaker, Wasserman, Rosen & Fernandez

[57] ABSTRACT

An offshore oil production terminal system is described, of the type which includes a tall transfer structure that has a nonrotatable tower anchored to the sea floor and a rotatable portion that rotates with respect to the nonrotatable tower and is connected to a dedicated storage vessel. A fluid conduit of the system has a nonrotatable portion extending from the sea bed up alongside and through the tower to a fluid swivel at the top of the tower, the conduit also having a rotatable portion extending from the fluid swivel to the vessel. A choke located in the nonrotatable tower along the fluid conduit, decreases the high pressure of oil from the sea bed (e.g. 2,000 psi) to a moderate pressure (e.g. 200 psi) for passage through the fluid swivel, so that a moderate pressure fluid swivel can be utilized. In a system wherein the rotatable transfer structure portion is fixed to the vessel, the tower has a control deck at substantially the same level as the vessel deck and with a circular periphery. This facilitates entry of personnel onto the control system deck of the tower, and permits operation of a multitude of controls that are directly connected to various stationary valves and the like on the production trees at the sea bed without requiring rotational joints between the controls and the devices they operate. Power to produce pressured hydraulic fluid for controlling valves and the like, can be obtained by the passage of a powering fluid such as moderate pressure air (e.g. 200 psi) through a fluid swivel on top of the tower to an air-motor-hydraulic pump combination in the fixed tower, to produce high pressure hydraulic fluid (e.g. 3,000 psi) for control system operation.

9 Claims, 9 Drawing Figures

106
104
39
42
10
55
52
50
105
24
48
14
32
12
30
26
28
28
35
37
40
34
36
20
80
22
82
16
18
18
38

FIG. 8
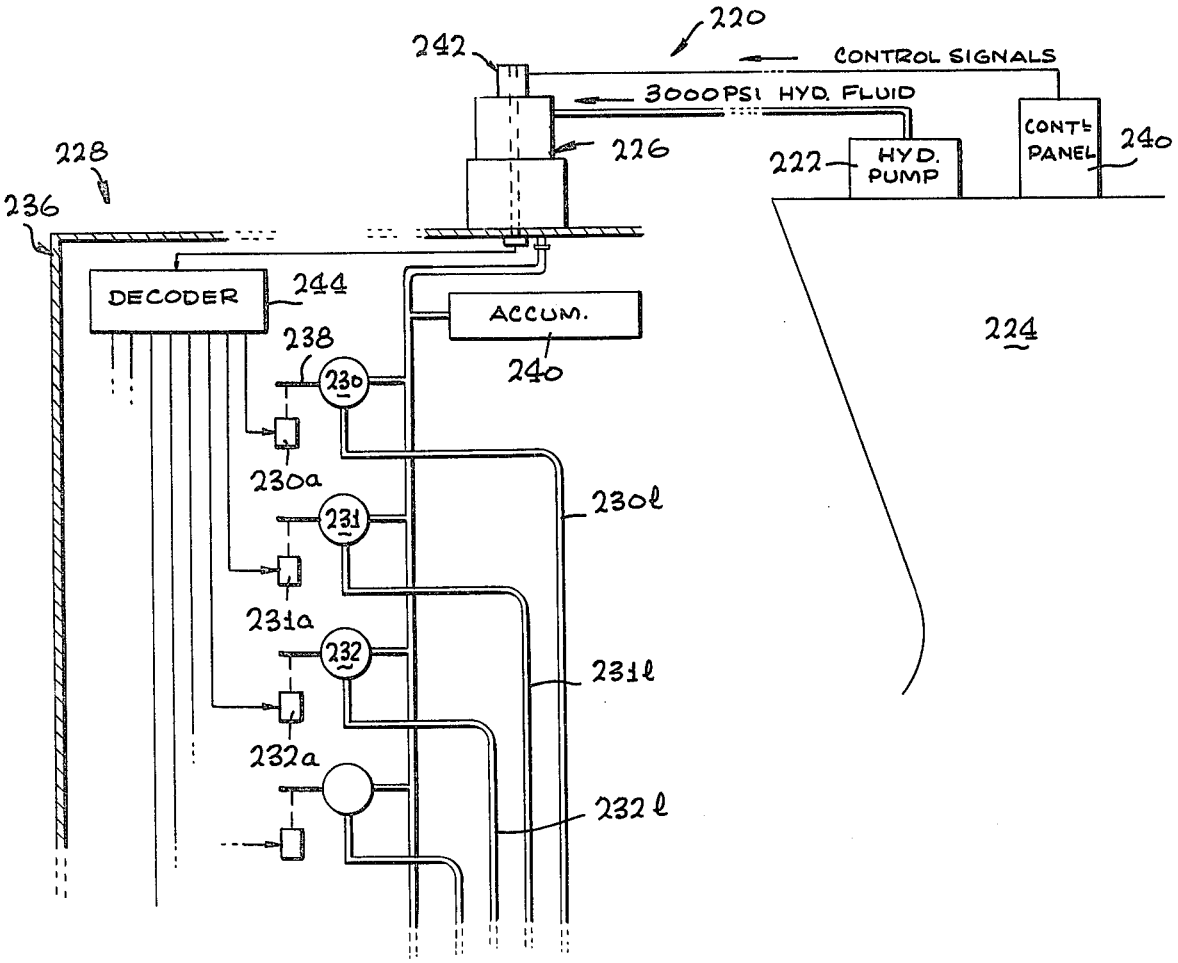
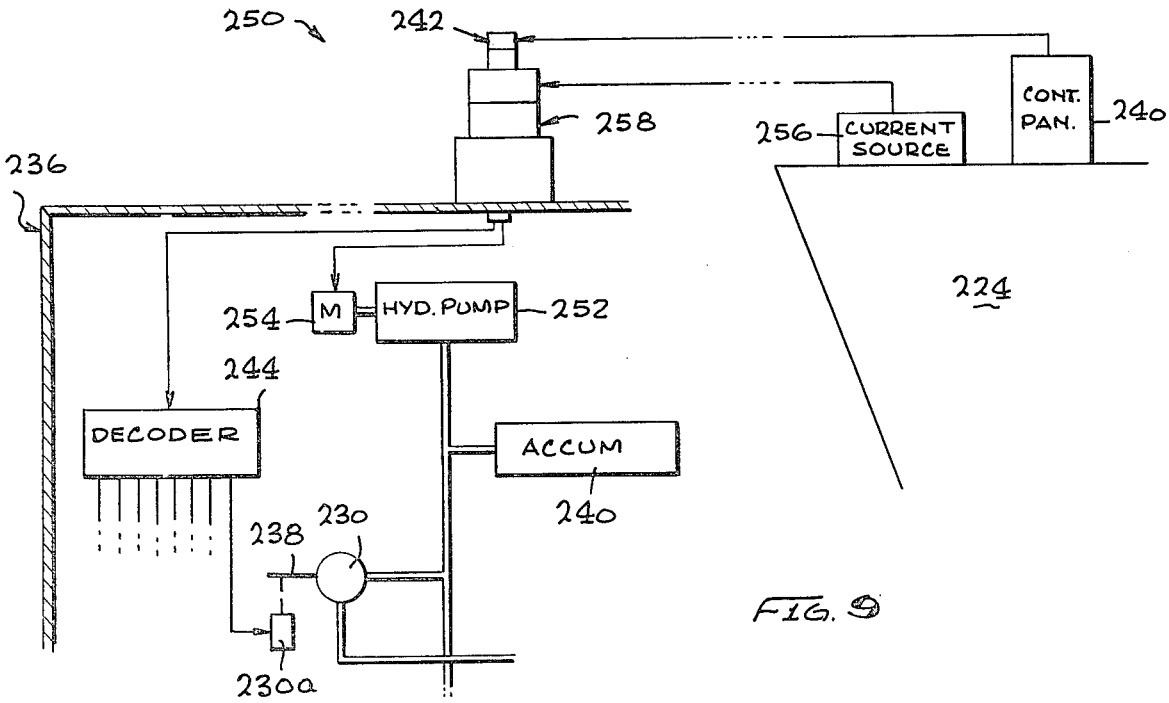
FIG. 9

HYDROCARBON PRODUCTION TERMINAL

CROSS-REFERENCE TO RELATED APPLICATIONS

This is a continuation-in-part of U.S. Ser. No. 049,960 filed June 18, 1979.

BACKGROUND OF THE INVENTION

Hydrocarbons such as oil from large offshore fields can be produced by large and extremely costly production platforms that include massive rigid structures fixed to the seabed and extending up to the sea surface. However, such platforms are too costly for use in the exploitation of small offshore oil fields, particularly when the marginal field is in deep water, and may be unsuitable. A relatively low cost production system with a short lead time can be provided by utilizing a dedicated storage vessel and a transfer structure which can be connected to one end of the vessel and moored to the sea floor by a piled base or catenary chains, and which can be utilized with fluid conduits that extend from the sea floor through the transfer structure to the vessel. Such a transfer structure can include a relatively stationary portion anchored to the sea floor, and a rotatable portion which is connected to the vessel to permit the vessel to rotate without limit about the stationary portion under the influence of currents, winds, and waves. It may be noted that such a stationary transfer structure portion can move, but is restrained against movement without limit, while the vessel is able to rotate without limit about a vertical axis about the stationary structure portion.

One disadvantage in using a vessel which can drift about the transfer structure, is that rotatable connections must be made between the rotatable vessel and stationary conduits or other lines that extend down to the sea floor. One rotatable joint is a fluid swivel for carrying oil from undersea wells to the vessel. However, such wells typically produce oil at high pressures such as thousands of psi, while moderate cost fluid swivels designed to carry pumped oil normally operate at pressures of only up to a few hundred psi. Since fluid swivels are costly and high maintenance items, the cost and maintenance of the production system would be greatly increased if very high pressure fluid swivels had to be utilized to carry oil from a plurality of subsea oil wells to the vessel.

The rotational movement of the vessel relative to the fixed tower of the transfer structure, can also complicate controls for the system. A typical control arrangement utilizes many high pressure hydraulic fluid lines to operate various underwater valves and the like, with the hydraulic lines carrying pressures of perhaps a few thousand psi. While it is possible to utilize a shipboard power station and hydraulic pump and control assembly to create hydraulic control signals at thousands of psi, and to pass such signals through many fluid swivels to the stationary tower of the transfer structure, the required fluid swivel would be costly. A mooring and cargo transfer system for the transfer of fluid cargo and other fluids between a relatively stationary transfer structure portion and a rotatable vessel, which minimized the problems that can arise from rotation of the vessel, would facilitate the construction of moderate cost production systems as well as other dedicated vessel mooring systems.

SUMMARY OF THE INVENTION

In accordance with one embodiment of the present invention, an offshore hydrocarbon production terminal installation is provided which facilitates the transfer of oil or other hydrocarbons from an undersea oil well to a rotatable vessel, and which also facilitates the control of stationary underwater valves and the like by personnel normally quartered on the rotatable vessel. The installation includes one or more fluid conduits extending up from the sea floor through a transfer structure, and through a fluid swivel thereon to the vessel. The transfer structure has a tower which is relatively fixed in that it cannot rotate without limit about a vertical axis, and has a portion which can rotate and which is connected to the vessel. A choke in the fixed tower of the transfer structure is connected in series with the fluid conduit extending up from the sea floor to reduce the pressure of fluid received from the sea floor so that the fluid swivel which is downstream of this choke carries fluid at only a moderate pressure. This permits, for example, oil at thousands of psi received from an offshore oil well, to be passed through a swivel unit that is constructed to carry oil at a pressure of only a few hundred psi. Where a plurality of fluid conduits are used to carry oil from a plurality of different wells at the sea floor, chokes connected to the different conduits enable the fluids to be commingled in a common pressure manifold prior to passage through the produced fluid swivel.

Hydraulic control lines that carry control signals at high pressures such as thousands of psi to control underwater valves and the like, receive pressured hydraulic fluid from a source located in the tower of the transfer structure. The high pressure source, such as a pump which delivers hydraulic fluid at thousands of psi, is powered by a power fluid such as pressured air which is delivered at a moderate pressure such as a few hundred psi through a swivel unit that connects an air pump on the vessel to an air motor in the fixed tower that powers the hydraulic pump.

A control panel containing various controls is located at an upper control deck in the fixed tower. In a system wherein the rotatable transfer structure is fixed to the vessel, the tower control deck is circular and located at approximately the same level as the main deck of the ship. As a result, personnel normally quartered on the vessel can easily access the control deck to operate the controls. This permits the use of a control panel which is fixed (not rotatable without limit) with respect to the hydraulic control lines and the like that connect the control panel to fixed valves and other remotely operated devices.

The novel features of the invention are set forth with particularity in the appended claims. The invention will be best understood from the following description when read in conjunction with the accompanying drawings.

BRIEF DESCRIPTION OF THE DRAWINGS

FIGS. 8 and 9 illustrate alternate hydraulic fluid control systems.

DESCRIPTION OF THE PREFERRED EMBODIMENT

Figure 1:
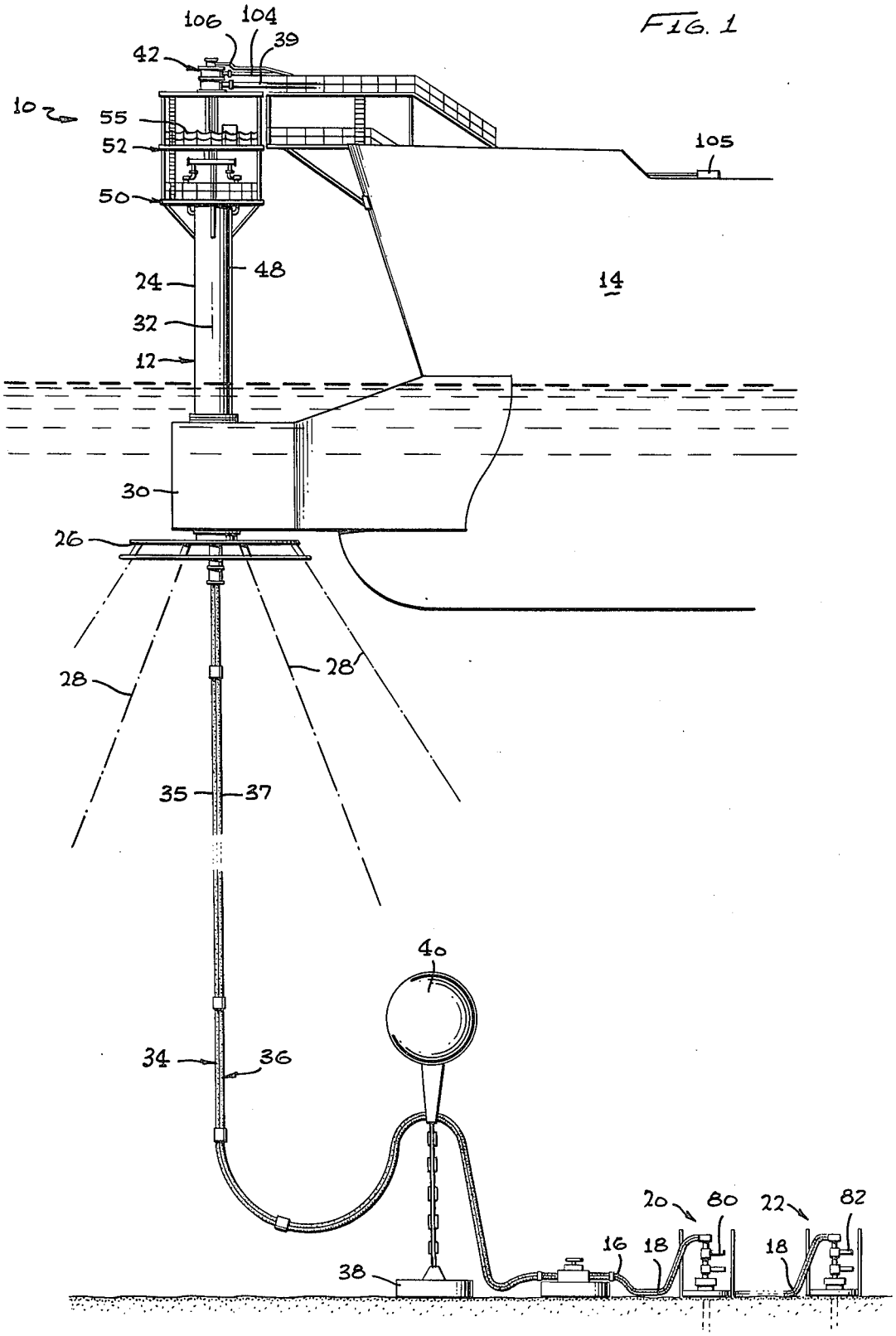
FIG. 1 is a partial side elevation view of a mooring system constructed in accordance with the present invention.
Figure 2:
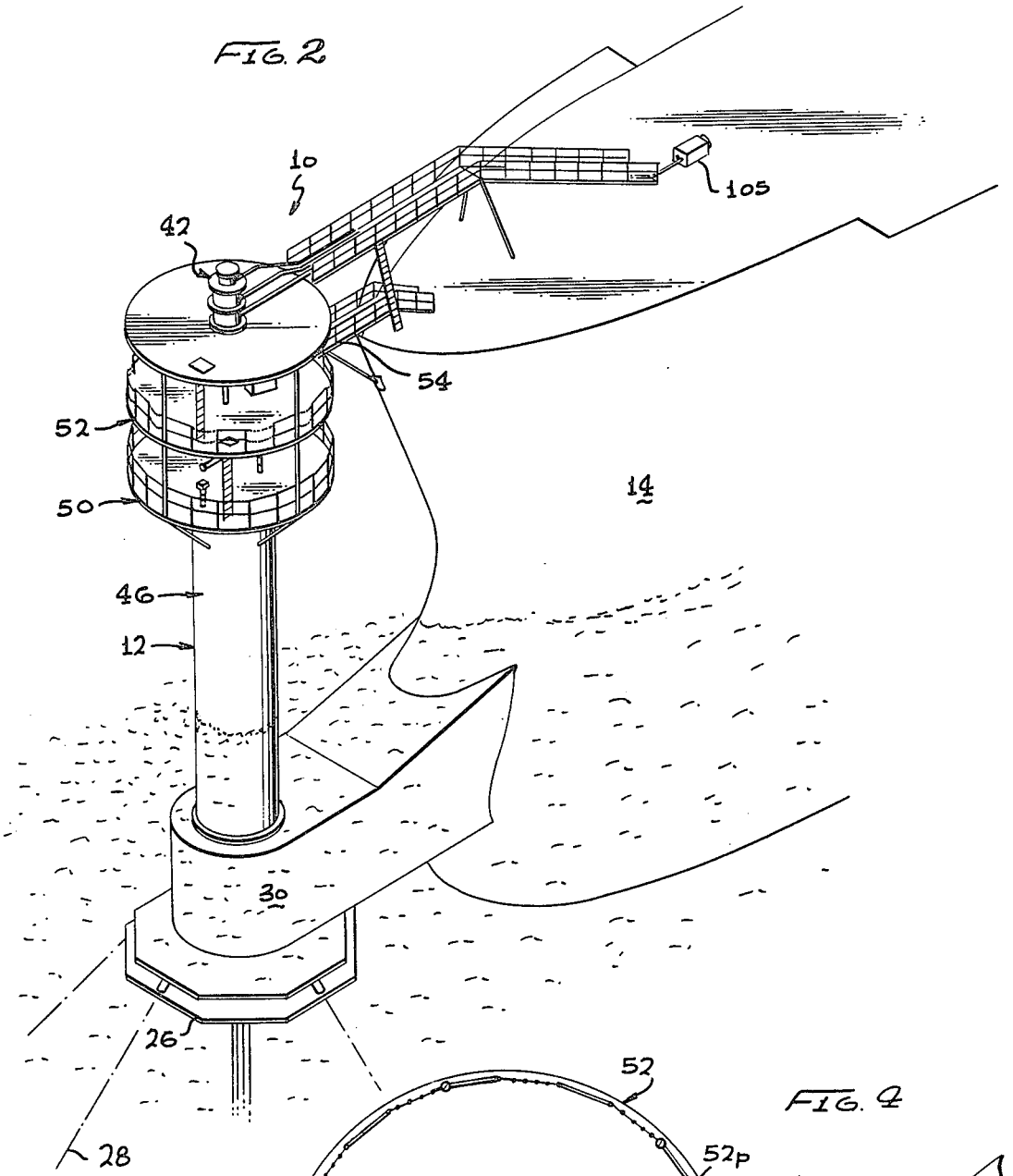
FIG. 2 is a partial perspective view of the system of FIG. 1.

FIG. 1 illustrates a fixed turret mooring system 10 of the present invention, which includes a negatively buoyant transfer structure 12 located substantially at the sea surface, for holding a floating storage vessel 14 and transferring a fluid cargo such as oil to the vessel. The oil is received from undersea pipelines 16, 18 connected to undersea oil wells 20, 22. The transfer structure 12 has a substantially nonrotatable frame 24 with a mooring chain table 26 at the bottom which is anchored by catenary chains 28 to the seabed, and has a rotatable frame 30 which is fixed to the vessel 14. This permits the vessel 14 to rotate without limit about the vertical axis 32 of the transfer structure under the influence of currents, waves, and wind, and yet the transfer structure anchors the vessel in an approximate location near the pipelines 16, 18. It may be noted that in referring to the frame 24 or a portion thereof as nonrotatable, or stationary, or fixed, it is meant that the frame cannot rotate without limit about a vertical axis. The frame 24 can pivot by a limited amount about the vertical axis, as well as tilt and shift position by a limited amount.

Oil from the pipeline 16, 18 passes through fluid conduits 34, 36 that include lower portions held over a sea floor base 38 by a support buoy 40. Each conduit includes a stationary riser portion 35, 37 that extends up to the transfer structure and vertically therealong to a swivel unit 42 at the top of the transfer structure. A pipe 39 which rotates with the vessel and which extends from the swivel unit 42 to the vessel 14 to deliver the oil to the vessel, serves as a portion of both conduits 34, 36. The term pipe refers to a conduit, and includes flexible conduits or hoses as well as rigid ones.

The use of a transfer structure 12 lying close to a storage vessel 14, and with the vessel movable substantially only in rotation about a vertical axis 32 with respect to the stationary portion of the transfer structure and to the fluid conduit or pipe portions that extend down to the sea floor, can result in a relatively simple and economical system. However, this system may still have considerable complexity, especially where it is utilized to produce oil from undersea wells. One of the problems encountered is that oil received from the wells such as 20, 22 may be at relatively high pressures such as thousands of psi, and in fact oil from different wells may be received at different pressures. Swivel units such as 42 of proven reliability are available for transferring fluids at pressures of a few hundred psi, which is a typical pressure range at which fluid may be pumped by pumps through lines. However, even these proven swivel units are of considerable cost and require considerable maintenance, so that it would be expected that swivel units which had to withstand pressures of thousands of psi would be considerably more expensive in construction and maintenance.

Another problem encountered in such systems, is that production installations normally require numerous remote controls, such as various valves at the sea floor, which can be best operated by hydraulic lines extending to the sea floor. Such hydraulic lines are typically operated at pressures of a few thousand psi. If such pressured hydraulic fluid had to be generated on board the vessel 14, another fluid swivel would be required to carry the hydraulic fluid, and such a fluid swivel carrying hydraulic fluid at thousands of psi would also be costly. In addition, the operation of a production installation requires the operation of numerous valves at the sea base, but by personnel normally quartered on the vessel 14. Thus, a large potential source of problems in the design of the installation concerns the relative rotation of the vessel 14 with respect to the fixed (i.e. substantially nonrotatable about a vertical axis) portion of the transfer structure and the fixed undersea pipelines and wells.

Figure 3:
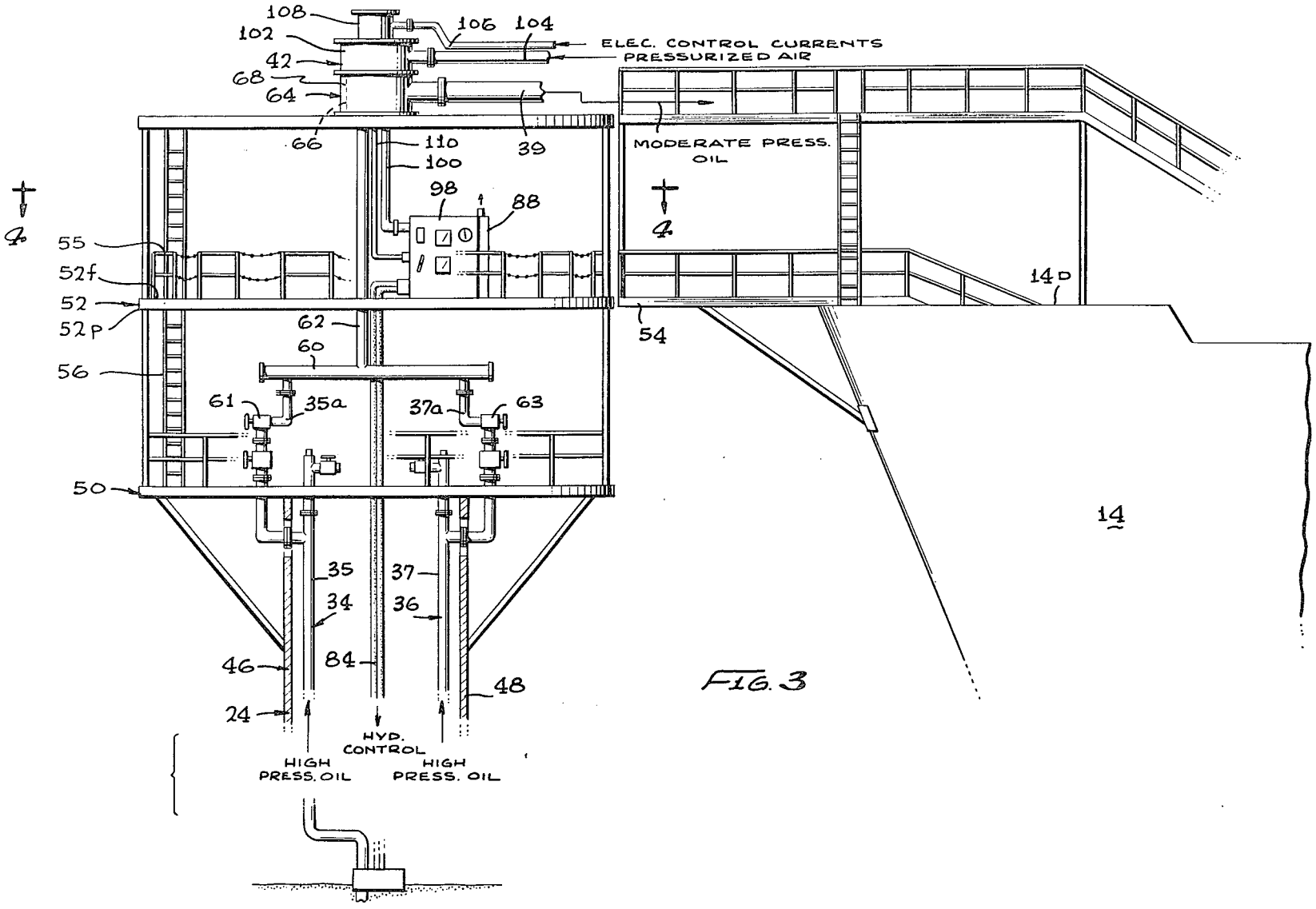
FIG. 3 is a partial sectional view of the system of FIG. 1.

FIG. 3 illustrates some of the details of the installation of FIG. 1. The fixed portion 24 of the transfer structure includes a turret or tower 46 having a hollow vertical enclosure 48 and a pair of decks 50, 52 at the top. A lowermost one of the decks 50 may be considered a manifold deck which includes various pipe and valve arrangements that require occasional operation, while the uppermost deck 52 may be considered a control center deck which requires more regular attention from personnel. The swivel unit 42 is a multiple product swivel unit, which lies above the upper deck 52, at the top of the tower. The floor of the upper deck 52 is located at substantially the same level as the deck 14D of the vessel, and of an extension 54 thereof which may be considered part of the vessel deck, to facilitate the passage of personnel normally quartered on the vessel 14, who can walk along the walkway 54 and then step directly onto the floor **52*f* of the upper deck 52. The upper deck floor has a circular periphery 52*p*, so that even though the vessel 14 may rotate to any position about the relatively stationary upper deck 52, personnel can always step from the walkway 54 onto the deck floor without crossing a wide gap. A fence 55 with multiple entrances is provided about the upper deck, as by providing multiple posts and chains strung between them that can be temporarily detached. Access to the lower deck 50 can be provided as by way of a ladder 56**.

The two riser portions 35, 37 of the fluid conduits include portions **35*a*, 37*a* which extend above the deck 50 to a manifold 60. Each conduit connects to a choke 61 or 63 which serves as a pressure reducing means to reduce the high pressure in the riser portion such as 35 of a conduit to a portion above the choke. The chokes, which may be considered portions of the fluid conduits, serve to enable the combining of high pressure oil from a plurality of wells into a single line, and also serve to greatly reduce the pressure of the flowing oil. For example, the lower portion or riser 35 of the conduit 34 may initially receive oil from the corresponding well at a pressure such as 2000 psi. The lower portion or riser 37 of the other conduit 36 may receive oil at a somewhat different pressure such as 3000 psi. So long as the pressure in the commingling manifold 60** is maintained at less than 2000 psi, fluid from both wells can flow into it.

The chokes 61, 63 are adjusted so that a moderate pressure of only a few hundred psi is maintained in the manifold 60 and in a line 62, leading downstream from the choke to the swivel unit. This enables a fluid swivel 42 to be utilized which is capable of carrying fluid at only a moderate pressure such as a few hundred psi.

The fluid swivel 42 includes a cargo-carrying portion 64, which may be considered part of the fluid conduits, and which has a nonrotatable part 66 that is connected to the pipe 62 and a rotatable part 68 that is connected to the rotatable pipe 39 that rotates with the vessel 14. It may be noted that the pipes 62 and 39 serve as portions of both fluid conduits 34, 36 which extend from the sea bed to the vessel. The pressure of perhaps 200 psi of oil flowing through the fluid swivel portion 64 is adequate to flow oil at a high rate to the vessel, and yet is small enough to permit the use of a fluid swivel portion 64 which is capable of withstanding pressures of only a few hundred psi. Thus, by reducing the high pressure of oil on a nonrotatable portion of the transfer structure, the oil can be transferred to the rotating vessel by the use of a fluid swivel which must withstand only a moderate pressure instead of the high pressure of oil found at the well head.

Figure 4:
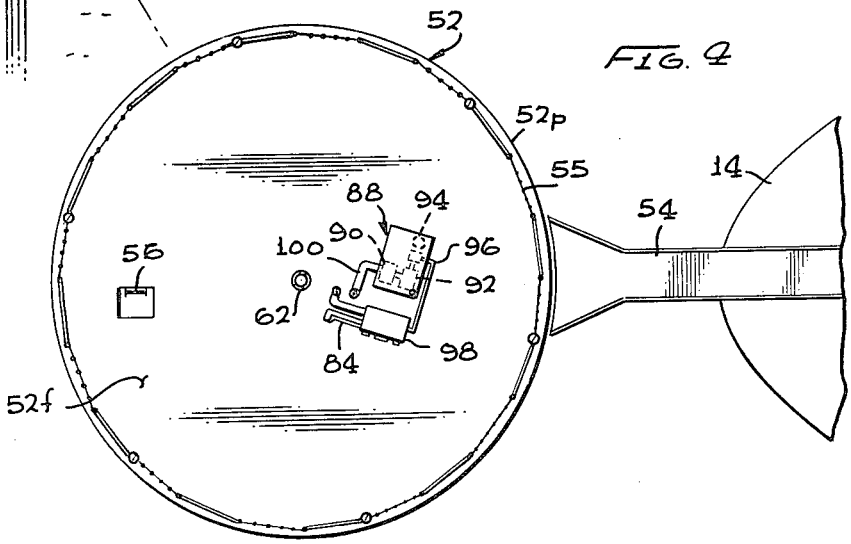
FIG. 4 is a view taken on the line 4—4 of FIG. 3.

A production installation normally requires many remotely operated valves. For example, FIG. 1 shows a pair of well head valves 80, 82 that permit the shut off of oil from the wells. Typical installations utilize a number of remotely operated valves, including a valve lying under the seabed surface to close the well in case of damage to the above seabed installation that would otherwise permit flow of oil into the surrounding sea to pollute it. A typical installation utilizes hydraulic pressure to operate the valves, using fail safe type valves that are held open only during the application of high hydraulic pressures to them and which automatically close when the hydraulic pressures are reduced. Hydraulic control lines 84 (FIG. 3) are provided that extend down from the transfer structure parallel to the cargo-carrying conduits at 34, 36 to the seabed. The lines carry hydraulic pressures of up to a few thousand psi. It would be costly to provide a large number of high pressure swivels to transfer hydraulic control fluids separately to each of the numerous underwater valves of a production installation. To provide for such high hydraulic pressures, without requiring the transference of such high pressures between the rotating vessel 14 and the stationary tower 46, a motor-pump apparatus 88 is provided on the fixed turret 46 to form a pressured hydraulic fluid source. As also shown in FIG. 4, the motor-pump apparatus 88 includes an air motor 90 which drives a hydraulic pump 92 that delivers pressured hydraulic fluid to an accumulator 94 and to an outlet 96. The outlet 96 is delivered to a control station 98 which includes various controls that can operate hydraulic valves and other devices. The air motor 90 is driven by a power fluid such as compressed air received over a pressured air line 100. The pressure air line 100 is connected through another fluid swivel 102 (FIG. 3) that connects to a rotating air line 104 that extends to an air compressor 105 on the vessel 14. Pressured air can be delivered at a moderate pressure such as 200 psi through the swivel unit 102 to the motor-pump set 88 to power it so as to generate hydraulic pressures such as 3000 psi.

The various valves and other remotely controlled devices are normally operated by a person quartered on the vessel 14 who walks across the walkway 54 on the control deck 52 to stand or sit beside the control station 98. However, it is also desirable to provide for operation of at least some critical controls from the vessel 14, to avoid the need for personnel to be stationed on the transfer structure during violent storms. To accomplish this, an electrical control line 106 is provided which carries control currents through a rotating electrical transfer apparatus 108, which may utilize conventional techniques such as a wiper which presses against a rotating conduction ring, to deliver currents through a line 110 to the control station 98 to permit remote operation of certain controls thereof.

While the pressure reducing apparatus is shown utilized for a subsea production and storage terminal wherein the transfer structure can be negatively buoyant by fixing its rotatable frame 30 to the vessel, it is also possible to utilize the pressure reduction apparatus in other systems where the transfer structure is independently buoyant. In the case of an independently buoyant transfer structure for a production and storage terminal, the dedicated vessel can be allowed to pivot about one or more horizontal axes as well as rotate about a vertical axis, relative to the fixed portion of the transfer structure. Accordingly, one or more auxiliary fluid swivels may be required along the fluid conduit extending between the fluid swivel mounted on the transfer structure and the vessel. The use of a choke to reduce the pressure of oil, from a high level such as 2000 psi to a moderate level such as 200 psi, can be of a great benefit in simplifying the multiple fluid swivels in such systems.

Figure 5:
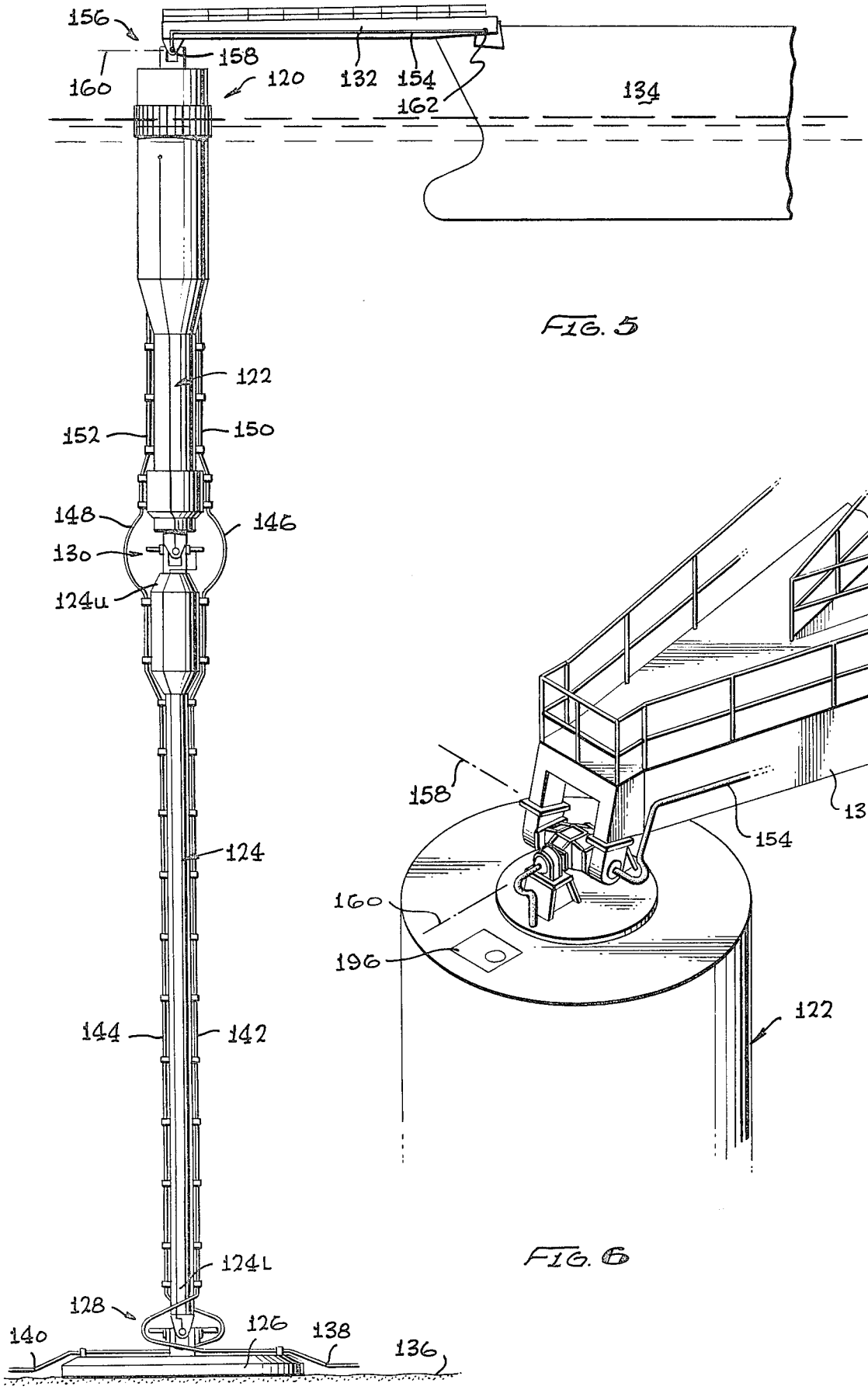
FIG. 5 is a side elevation view of a mooring system constructed in accordance with another embodiment of the invention.
Figure 6:
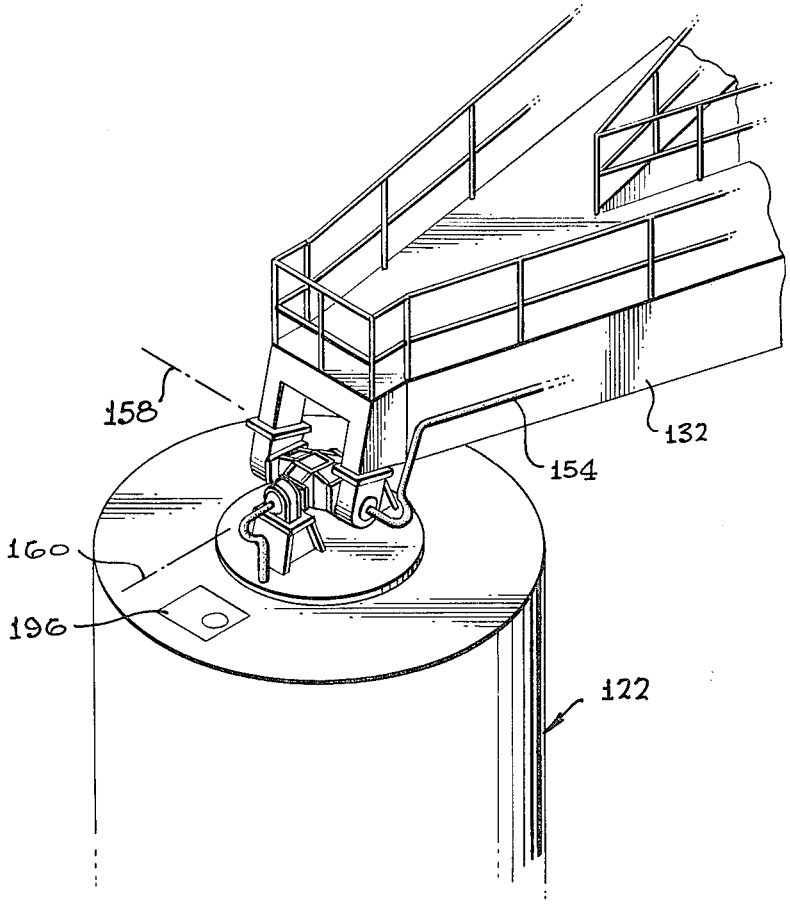
FIG. 6 is a partial perspective view of the system of FIG. 5.
Figure 7:
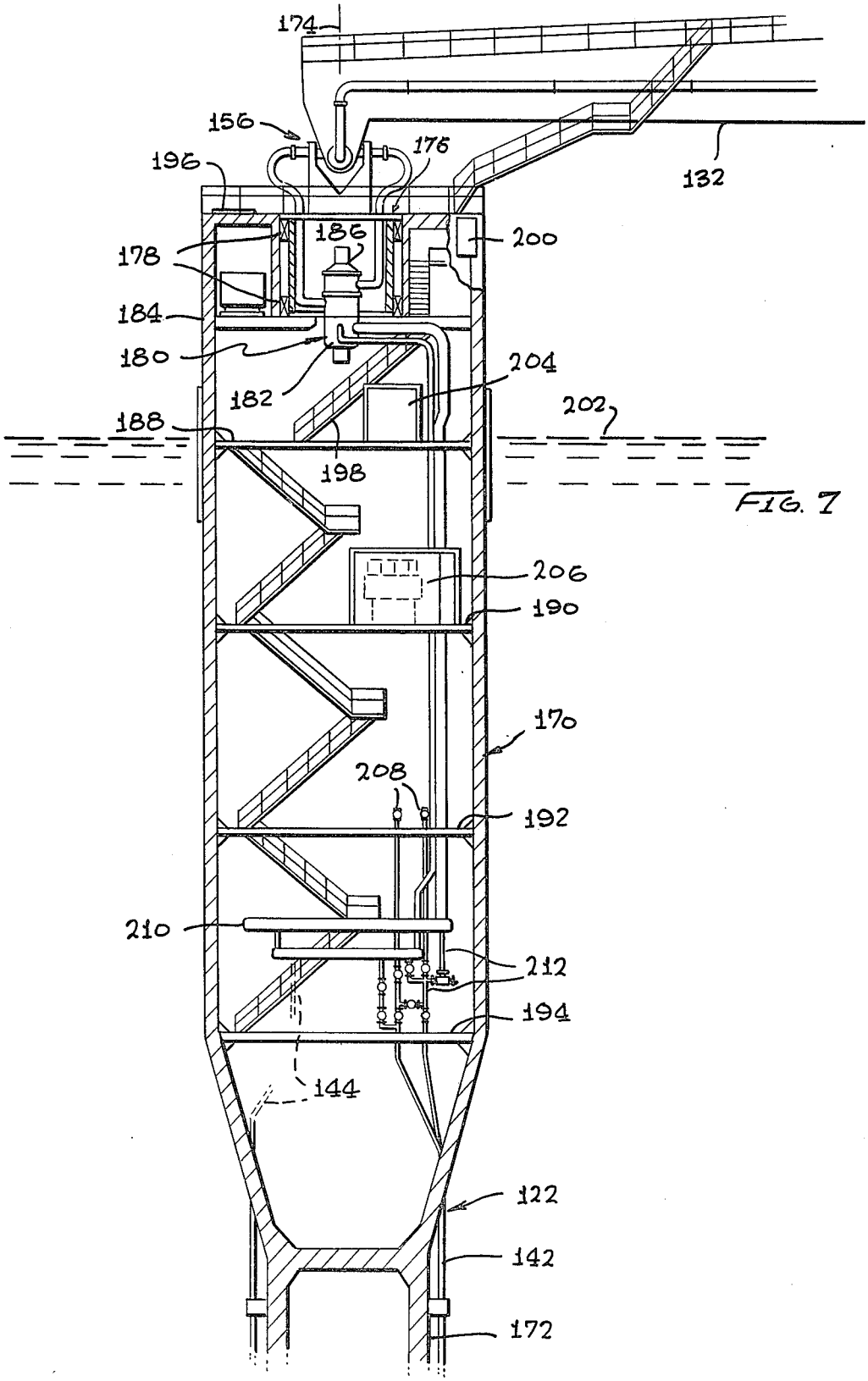
FIG. 7 is a partial sectional view of the system of FIG. 5.

FIGS. 5–7 illustrate a production terminal 120 of the single anchor leg mooring type (SALM). SALM terminals are useful in many circumstances where catenary anchoring is not desirable, as in deep water where large excursions of the ship can occur due to the long chain lengths so that very long hoses may be required and where the chain weights may become excessive. The system 120 includes an upper buoy tower 122 anchored by a column-like riser 124 which has a lower end 124L connected to a sea base by a pivot joint 128, and having an upper end 124U connected to the bottom of the buoy 122 by another pivot joint 130. In only moderately deep water, a continuous column or tower may be used which extends from the sea floor to the sea surface, instead of an articulated one. Both pivot joints 128, 130 are tilt joints which permit relative tilting of the riser 124 to either the sea base 126 or tower 122, but which do not permit unlimited rotation about a substantially vertical axis (and in fact do not permit any substantial rotation about a vertical axis). The upper end of the tower 122 is connected by a yoke 132 to a storage vessel 134. The tower 122 serves as a transfer structure which connects pipe lines 138, 140 at the sea floor to the vessel, by means of fluid conduits that include riser conduits 142, 144 extending along the riser 124, a pair of flexible pipes 146, 148, a pair of upper riser pipes, 150, 152 and a single pipe 154 which extends along the yoke to the vessel.

In the SALM terminal 120, the height of the tower 122 above the seabed 136 is substantially fixed at any orientation of the riser 124. Accordingly, the yoke 132 must be allowed to tilt with respect to the tower 122, and in fact a tilt joint 156 is provided at the tower end of the yoke to permit tilting about two axes 158, 160, while an additional pivot joint at 162 is provided at the vessel end of the yoke.

As shown in FIG. 7, the tower 122 includes an upper buoyancy chamber 170 which contains several decks having control apparatus for controlling operation of the terminal, and a lower hollow spacer portion 172 which serves to hold the tower at the desired height above the seabed. The tower 170 is relatively fixed, in that it cannot rotate without limit about a vertical axis 174, and in fact is not allowed to rotate appreciably. A rotatable frame 176 rotatably mounted on bearings 178 to the tower, is connected to the tower-end of the yoke 132 to rotate with it. A multiple product fluid swivel 180 has a stationary portion 182 fixed to a deck 184 of the fixed tower, and supports a rotatable swivel portion 186 that can rotate about a vertical axis independently of the bearings 178 so as to avoid the transference of yoke mooring forces through the fluid swivel.

The chamber of the fixed tower 122 has multiple decks including the access level deck 184, a control system deck 188, a power unit deck 190, a launching deck 192 and a manifold deck 194. A freight access hatch 196 is provided over each deck, and additional personnel stairway passages 198 are provided to permit ready access to all of the decks. A personnel access hatch 200 is provided above the water line. The chamber 170 is water tight along most of its height, from a level above the level 202 of the sea at average tide level to the bottom of the chamber. Personnel who are quartered on the vessel, can be stationed on the control deck 188 to operate a control panel 204, and can move to the power unit deck to service a power unit and hydraulic control system 206, or to a launching deck where pipe openings at 208 are provided to receive tools that move through the fluid lines, or to the manifold deck 194 to service a manifold 210 and production chokes 212.

The fixed tower 122 tilts only moderately during drifting of the vessel. An especially large diameter upper buoyancy chamber 170 is not required, since the considerable underwater length of the tower 122 can be utilized to accommodate the required equipment for operation of the terminal. The terminal utilizes choking of multiple fluid lines such as 142, 144 carrying high pressure oil from the sea base, to permit comingling of the fluid in the header 210, and includes pressure reducing apparatus that allows only moderate pressures such as 200 psi of fluid to flow through the fluid swivel 180, and additional fluid swivels at the yoke-to-buoy coupling 156 and at the vessel end of the yoke. Although a chain riser could be used to connect the tower 122 to the sea base, a column riser has the advantage of allowing largely rigid pipes to be used along most of the riser conduits to increase reliability, and in deep water locations avoids very long and heavy chains and very long hoses.

As discussed above, it is necessary to operate numerous underwater hydraulic valves in a typical offshore production installation. However, it is undesirable to utilize a large number of high pressure fluid swivels to carry hydraulic control fluids from the rotating ship through the nonrotating portion of the transfer structure to the valves. A typical subsea well utilizes about ten hydraulic valves, so that an installation which produces from four wells might require on the order of forty swivel units if hydraulic control fluids were delivered from the vessel. As also discussed above, such multiple high pressure (e.g. 3000 psi) swivel units can be avoided by stationing the hydraulic controls that control the flow of hydraulic fluid to each underwater valve (or other hydraulically operated devices), on the nonrotatable portion of the transfer structure. Although it is possible to operate such controls by personnel on the transfer structure, it is also possible to operate them remotely from the ship, as by a radio control or by an electrical swivel unit with slip rings and wipers (or an optical or electromagnetic equivalent) to carry control signals.

FIG. 8 illustrates a system 220 wherein hydraulic fluid under high pressure such as 3000 psi is supplied by a hydraulic pump 222 on the ship 224, through a small swivel unit 226 on the transfer structure 228, to a group of controls 230, 231, 232 etc. located on the nonrotatable portion or tower 236 of the transfer structure. Each control such as 230 has a handle 238 for manual operation, as well as a remotely operable activator 230*a*, 231*a*, 232*a*, etc., to control the delivery of hydraulic fluid through a corresponding control line 230*l*, 231*l*, 232*l*, etc. to underwater valves. A single, relatively small, high pressure fluid swivel 226 can be used to supply fluid to all the controls, with an accumulator 240 being provided to supply temporary large flows of hydraulic fluid as when many valves are opened at the same time. A small high pressure fluid swivel can, of course, be more easily sealed than a large one. An additional swivel (not shown) may be utilized to return hydraulic fluid to the intake of the pump 222.

The remotely operable activators such as 230*a*, can be operated from a control panel 240 on the ship. The operation of switches on the panel 240 produces digital signals, with each signal defining the particular one of the controls 230, 231, etc. to be operated. The signals pass through an electrical swivel unit 242 to a decoder 244 on the nonrotatable tower 236 to a corresponding one of the activators 230*a*, 231*a*, etc. Of course, it would be possible to provide a separate electrical swivel unit portion for each activator.

FIG. 9 illustrates another system 250 wherein pressured hydraulic fluid is supplied by a hydraulic pump 252 driven by an electric motor 254, with both located on the nonrotatable portion 236 of the transfer structure. Current to power the motor is provided by a current source 256 on the ship 224, with the current passing through an electrical swivel unit 258 (which may include slip rings and wipers) on the transfer structure, to the motor.

Thus, the invention provides an offshore terminal installation or system of a type which includes a transfer structure with a substantially stationary portion connected by fluid lines to the sea floor and by rotating fluid lines to a rotating vessel by means of a fluid swivel, which minimizes problems caused by relative rotation of the vessel to the stationary portion of the transfer structure. High pressure fluids received from the sea floor are first reduced in pressure to a moderate level, such as from several thousand p.s.i. to a few hundred psi, before passage through a fluid swivel to the vessel, thereby permitting a less complicated and lower cost fluid swivel to be utilized. Multiple controls which deliver high pressure hydraulic fluid over multiple hydraulic lines to valves and the like at the sea floor can be located on the stationary portion of the transfer structure to avoid the need for a large number of high pressure fluid swivels. Where the transfer structure is fixed to the vessel, the stationary transfer structure portion can include a deck with a substantially circular perimeter that permits easy access by personnel quartered on the rotatable vessel.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. In an offshore undersea hydrocarbon production terminal installation which includes a transfer structure with a portion that lies substantially at the sea surface and is anchored to the sea floor and connected to a floating storage vessel, and a fluid conduit which extends from the sea floor through the transfer structure to the vessel, to carry high pressure fluid from an oil well at the sea floor to the vessel, and wherein the vessel and a portion of the transfer structure must be allowed to rotate without limit about a vertical axis, the improvement wherein:

said transfer structure includes a nonrotatable frame anchored to the sea floor so it cannot rotate without limit about a vertical axis, and a rotatable frame which can rotate without limit about a vertical axis and which is connected to the vessel;

said fluid conduit includes a fluid swivel having a nonrotatable swivel portion substantially fixed to said nonrotatable frame and a rotatable swivel portion, and said fluid conduit also includes a rotating conduit portion connecting the rotatable swivel portion to the vessel; and said fluid conduit also includes a riser conduit portion extending from substantially the sea floor to said transfer structure, and a pressure reducing means mounted on said nonrotatable frame and connected between said riser conduit portion and said nonrotatable fluid swivel portion, for reducing the pressure of fluid that is delivered to the fluid swivel, to enable a moderate pressure fluid swivel to be used to carry initially high pressure fluid from the sea floor to the vessel;

said nonrotatable frame being positioned close enough to said vessel so a seaman stationed on said vessel can walk from said vessel to said frame to service said pressure reducing means and can then walk directly back to said vessel.

2. The improvement described in claim 1 wherein:

said terminal includes a second fluid conduit having a second riser portion extending from the sea floor to said transfer structure, to carry fluid at a high pressure that may be different from the pressure in said first mentioned riser conduit portion;

said first riser portion includes a manifold connected between said pressure reducing means and said fluid swivel; and said second fluid conduit includes a second pressure reducing means having an outlet connected to said manifold, said second pressure reducing means and said manifold both mounted on said nonrotatable frame, whereby to enable passage of high pressure fluid from a plurality of high pressure wells through a single moderate pressure fluid swivel.

3. The improvement described in claim 2 wherein:

said nonrotatable portion of said transfer structure includes upper and lower decks and said pressure reducing means and manifold are located on said lower deck;

said terminal installation includes a plurality of remotely operable valves, and said transfer structure includes a plurality of fluid controls located on said upper deck;

said rotatable frame of said transfer structure is fixed to said vessel; and said vessel has a vessel deck adjacent to said transfer structure, and said transfer structure upper deck has a substantially circular floor located at substantially the same level as the deck.

4. The improvement described in claim 1 wherein:

said transfer structure comprises a buoyant tower, and said anchor means comprises a sea base and a riser having a lower end pivotally connected to the sea base to permit tilting and an upper end connected to said tower;

said tower being hollow, having an access opening above water level, and having at least one deck below said opening and means for enabling personnel to reach said deck from said opening, and said pressure reducing means is located at said deck;

said opening being positioned so it can be reached by walking from the vessel to the opening.

5. An offshore terminal disposed over a seabed, comprising:

a storage vessel;

a transfer structure having a nonrotatable portion and having a rotatable portion fixed to the vessel;

means for anchoring said nonrotatable portion of said structure to the sea bed;

said nonrotatable portion of said structure including a transfer structure deck with a floor having a substantially circular periphery, and said vessel forming a walkway with an end at substantially the same height as said deck floor and lying adjacent thereto, to permit a person to walk onto the transfer structure deck floor at any rotational position of the vessel relative to the nonrotatable portion of the structure.

6. An offshore hydrocarbon production system for storing oil produced by underwater wells, comprising:

a dedicated storage vessel;

a transfer structure having a nonrotatable tower and having a rotatable frame rotatable about a vertical axis on said tower and coupled to said vessel to rotate with it about a substantially vertical axis;

means anchoring said tower to the sea bed;

a fluid swivel having a stationary portion mounted on said tower and a rotatable portion;

a first conduit connecting said rotatable portion of said fluid swivel to said vessel; and a second fluid conduit extending from an underwater well to said tower, and coupled to said stationary portion of said fluid swivel;

said anchoring means including a sea base lying at the sea bed and a riser having a lower end coupled to said sea base and an upper end coupled to said tower;

said tower including a water-tight enclosure having an entrance accessible by walking directly from said vessel said enclosure having at least one deck region and including production control equipment in said deck regions.

7. In an offshore production terminal for delivering hydrocarbons from at least one subsea well through a fluid conduit to a storage vessel, by way of a transfer structure that has a largely nonrotatable portion anchored to the sea floor so it does not rotate without limit about a vertical axis and a rotatable portion connected to the ship to rotate with the ship about a largely vertical axis, and wherein a plurality of underwater hydraulic valves are located along or near the fluid conduit and the valves are designed for individual control by high pressure hydraulic fluid delivered through hydraulic lines, the improvement comprising:

hydraulic fluid supply means having an outlet on said nonrotatable transfer structure portion, for supplying hydraulic fluid at high pressure; and a plurality of hydraulic controls located on said nonrotatable transfer structure portion, each control coupled to said hydraulic fluid supply means to receive high pressure hydraulic fluid, and each control also coupled to a corresponding underwater hydraulic valve to selectively supply high pressure fluid that operates the valve;

said hydraulic fluid supply means including a hydraulic pump device mounted on said nonrotatable portion of said transfer structure, a power source located on said vessel, and a power-carrying swivel unit having a rotatable portion coupled to said power source and a nonrotatable portion coupled to said hydraulic pump device to supply power to operate it.

8. The improvement described in claim 7 wherein: said power source is constructed to supply electrical current and said hydraulic pump device includes an electric motor and a hydraulic pump driven by said motor.

9. The improvement described in claim 7 wherein: said power source is constructed to supply pressured air at a pressure less the pressure of hydraulic fluid supplied by said hydraulic pump device and said hydraulic pump device includes an air-powered motor and a hydraulic pump driven by said motor.

* * * * *